US005279135A

United States Patent [19]

Leyden et al.

[11] Patent Number: 5,279,135

[45] Date of Patent: Jan. 18, 1994

[54] SECURITY CABLE

[75] Inventors: Roger J. Leyden, Willow Springs; Terrance Surma, Bloomingdale, both of Ill.

[73] Assignee: Se-Kure Controls, Chicago, Ill.

[21] Appl. No.: 945,102

[22] Filed: Sep. 15, 1992

[51] Int. Cl.[5] ..... E05B 69/00

[52] U.S. Cl. ..... 70/18; 70/59

[58] Field of Search ..... 70/30, 18, 49, 59, 60; 211/4; 267/169, 179, 180; 446/486

[56] References Cited

U.S. PATENT DOCUMENTS

| | | | |
|---|---|---|---|
| 769,362 | 9/1904 | Terry | 267/180 |
| 3,767,180 | 10/1973 | Kaiser | 267/179 |
| 3,886,770 | 6/1975 | Smith | 70/18 |
| 4,069,691 | 1/1978 | Simpson | 70/18 |
| 4,093,198 | 6/1978 | Peterson | 267/179 |
| 4,738,341 | 4/1988 | Asano | 70/18 |
| 4,811,577 | 3/1989 | Webster et al. | 70/18 |
| 5,154,072 | 10/1992 | Leyden | 211/4 |

FOREIGN PATENT DOCUMENTS

| | | | |
|---|---|---|---|
| 385821 | 3/1908 | France | 446/486 |
| 2167969 | 6/1986 | United Kingdom | 446/486 |

*Primary Examiner*—Peter M. Cuomo
*Assistant Examiner*—Darnell M. Boucher
*Attorney, Agent, or Firm*—Wood, Phillips, VanSanten, Hoffman & Ertel

[57] ABSTRACT

A security device having an elongate, flexible cable with a preformed coil, with the coil being defined by at least three turns of cable which extend and retract to allow the effective length of the cable to be altered. At least a first and second of the turns are connected to each other to control the tendency of the coil to tangle as the coil is extended and retracted in use. A structure is provided on the cable to allow connection of the cable to an article to be secured.

20 Claims, 1 Drawing Sheet

FIG. 1
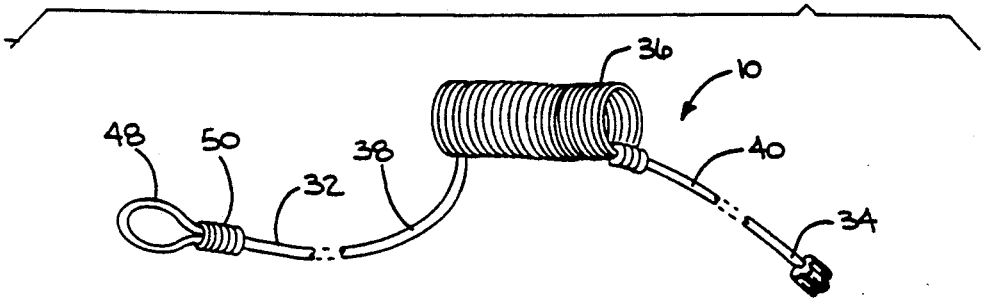
FIG. 2
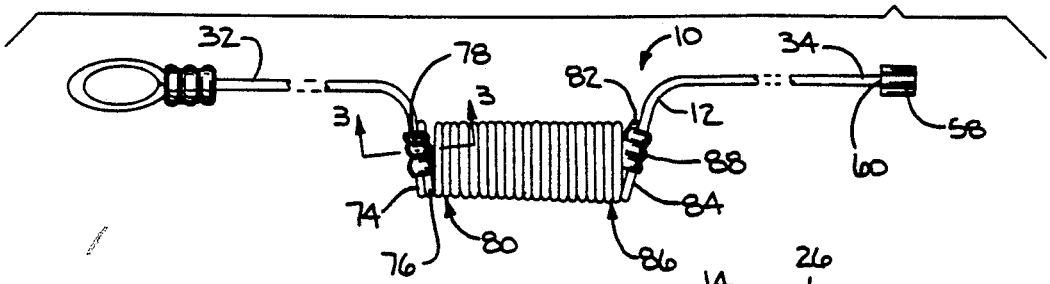
FIG. 3
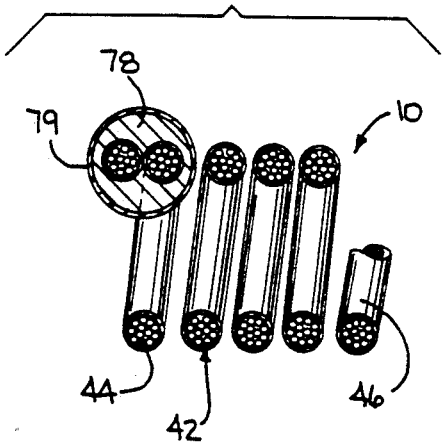
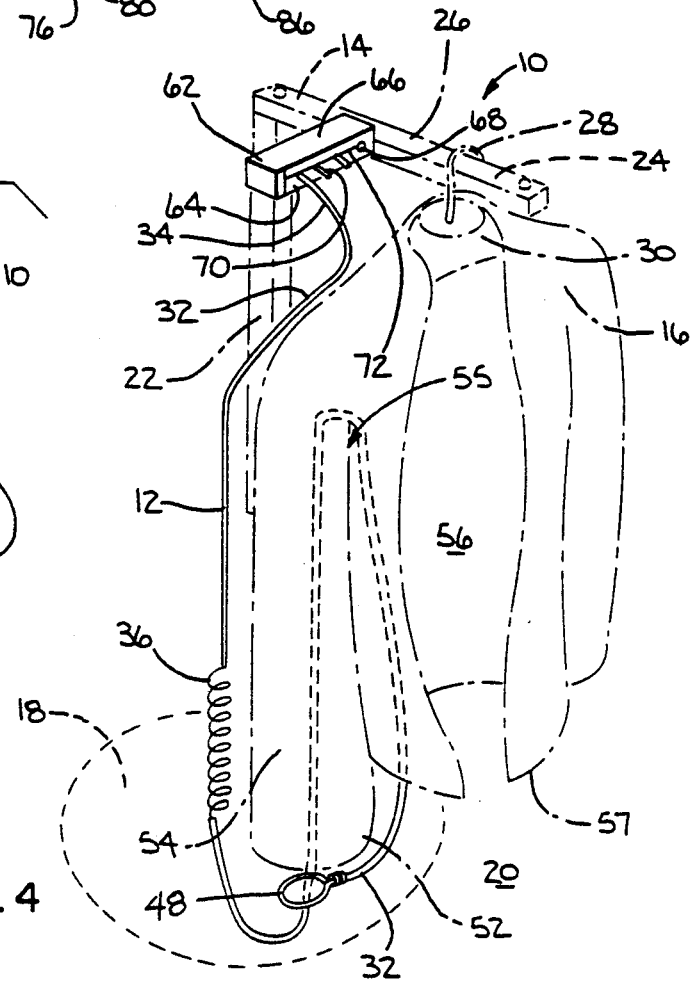
FIG. 4

SECURITY CABLE

BACKGROUND OF THE INVENTION

1. Field of the Invention

This invention relates to security devices and, more particularly, to an extensible cable that can be used to secure articles, such as garments, against theft.

2. Background Art

The clothing industry has been plagued by theft for many decades. The problem of theft is particularly prevalent in operations that display coats and other garments that lend themselves to being tried on in the vicinity of the racks on which they are displayed. It is not uncommon for individuals to walk off unnoticed wearing stolen garments.

Various types of security devices have been developed by the assignee herein, among which are devices for securing hangers to a display stand and devices for securing a flexible cable, connected to an article to be secured, to a lockable housing.

This latter device typically has an elongate, flexible locking cable. A loop is formed in one end of the cable to allow passage therethrough of the other end of the cable to define a constrictable lasso. The other end of the cable has a fitting thereon to be secured to a housing on a stand on which the garment is displayed. An exemplary housing suitable for locking a cable end is shown in U.S. application Ser. No. 676,825, assigned to the assignee herein.

In most such devices, the cable is looped through the sleeve of a garment and out the collar. An 8 foot cable allows the user the necessary freedom to remove the garment from the hanger on the display stand, and try the garment on, as to check for fit and appearance.

One serious drawback with this cable device is that with the cable made sufficiently long to allow the consumer to try the garment on, a substantial length of the cable will project from the sleeve and normally hang down close to or on the floor. Persons passing by the stand may trip on or become entangled with the excess cord. The potential for personal injury thus exists.

One proposed solution to this problem has been to preform the cable with a coil having a plurality of turns which are extendable and retractable to allow variation of the cable length. With the cable in a relaxed state, the coil reduces the effective length of the cable. Typically, the coil is constructed to eliminate on the order of two feet from the overall length of the cable. This is sufficient to elevate the cable above the floor so that it is not in the path of individuals passing by the display stand.

While the coil eliminates one problem, it introduces a different problem. The coil is prone to tangling as the coil is repeatedly extended and retracted as when the consumer removes the garment and stretches the cable to try the garment on. This phenomenon commonly occurs with flexible, coiled cords, such as conventional telephone cords that extend between a handset and receiver. Once the cable tangles, the coil may not be extendable to the required effective length to allow a garment to be tried on. Further, the tangled coil may obstruct the passage of a consumer's arm through a garment sleeve within which the cable resides.

To overcome the tangling problem, the garment purveyor may choose to eliminate the coil altogether and contend with the aforementioned problem of the cable's resting on or in close proximity to the floor.

SUMMARY OF THE INVENTION

The present invention is specifically directed to overcoming the above-enumerated problems in a novel and simple manner.

According to the invention, a security device is provided having an elongate, flexible cable with a preformed coil, with the coil being defined by at least three turns of cable which extend and retract to allow the effective length of the cable to be altered. At least a first and second of the turns are connected to each other to control the tendency of the coil to tangle as the coil is extended and retracted in use. A structure is provided on the cable to allow connection of the cable to an article to be secured.

By controlling coil tangling, the advantage of extensibility of the coiled cable can be fully realized without any of the problems of the prior art structures.

Typically, the cable has a metal core defined by woven metal strands. A protective outer sheath surrounds the metal core and is preferably made from a material that is softer than the metal core to shield the user and/or garments from the hard metal core.

To facilitate connection of the cable to an article to be secured, a loop is formed by the cable for allowing passage therethrough of one of the cable ends to define a constrictable lasso.

The one cable end may have a connector thereon to cooperate with a conventional housing, as may be fixed to a display stand for an article such as a garment.

In one form, the first and second turns are connected to each other by a crimp fitting.

In another form of the invention, the coil has at least five turns, and a third and fourth of the turns are connected to each other for the purpose of preventing tangling of the coil.

In one form, the cable has a straight, uncoiled section connected directly to one of the first and second coils.

The invention also comprehends a security device having an elongate flexible cable with spaced ends, a preformed coil between the spaced cable ends and defined by at least three turns of a flexible element which extends and retracts to allow the effective length of the cable to be altered, and structure for connecting first and second of the turns to prevent the first and second turns from spreading away from each other lengthwise of the coil.

The entire cable can be constructed from a single cable length or, alternatively, multiple coil lengths can be joined.

The invention further contemplates a security device having an elongate flexible cable with first and second ends, a preformed coil defined by a plurality of turns of a flexible element between the cable ends which turns extend and retract to allow the effective length of the cable between the first and second ends to be altered, and structure for controlling the tendency of the coil to tangle as the coil is extended and retracted.

BRIEF DESCRIPTION OF THE DRAWINGS

FIG. 1 is a perspective view of a security device according to the present invention;

FIG. 2 is a side elevation of the security device of FIG. 1;

FIG. 3 is an enlarged, cross-sectional view of a coiled section on the security device taken along line 3—3 of FIG. 2; and FIG. 4 is a perspective view of the security device operatively positioned to secure a garment relative to a display stand.

DETAILED DESCRIPTION OF THE DRAWINGS

A preferred form of security device, according to the present invention, is shown at 10 in FIGS. 1–4. The security device 10 consists of a cable 12 that is useable to secure an article to a display stand 14. While the security device 10 is useable to secure different types of articles, it is particularly useful in securing garments. A suitable garment/coat 16, which can be secured with the present invention, is shown in FIG. 4. It should be understood that the use of a garment/coat 16 in association with the security device 10 is only exemplary of the many articles that can be secured therewith.

A typical display stand 14 has a base 18 for supporting garments/coats 16 in a display position above a subjacent support 20. The display stand 14 has an upright post 22 and a horizontal arm 24 projecting substantially at a right angle from the upright post 22 in cantilever fashion. The arm 24 defines an upwardly facing surface 26 to support the hook 28 on a conventional hanger 30 to which the garment 16 is attached.

The cable 12 has first and second ends 32, 34, respectively. Between the cable ends 32, 34 is a preformed coil 36. A first straight cable section 38 extends from the coil 36 to define the first cable end 32. A second straight cable section 40 extends from the coil 36 to define the second cable end 34.

In a preferred form, the cable 12 is a single piece which defines the straight sections 38, 40 and the coil 36 therebetween. The cable 12 preferably has a metal core 42 defined by woven wire strands 44. The core 42 is surrounded by a rubber or plastic sheath 46. The sheath 46 provides a cushion layer to keep the metal core 42 from directly contacting any part of the display stand 14 and garment 16 supported thereon. The cable 12 is wrapped by conventional techniques, known to those skilled in the art, to define a coil 36.

At the cable end 32, the cable 12 is doubled back on itself to define a loop 48. The loop 48 is maintained by a crimp fitting 50 or by other suitable means. The loop 48 has a sufficient diameter to accept the cable end 34. With the cable end 34 passed through the loop 48, the cable 12 is configured as a constrictable lasso.

The lasso arrangement can be utilized to capture the garment 16. More specifically, the cable end 32 is passed through the bottom free end of the garment sleeve 54 to pass upwardly around the juncture at 55 between the sleeve 54 and the body 56 of the garment and downwardly through the open bottom edge 57 of the body 56. The loop 48 on the cable end 32 is then aligned with the bottom of the sleeve 54 to allow the cable end 34 to be passed therethrough and upwardly around the outside of the sleeve 54. With this arrangement, the garment 50 is positively captured by the cable 12 so long as the cable end 34 is not allowed to pass outwardly through the loop 48.

To facilitate connection of the cable 12 to the display stand 14, a fitting 58 is crimped to the cable end 34 and defines an enlargement with a shoulder 60 facing lengthwise of the cable 12. The cable end 34 is releasably locked within a housing 62 fixed to the arm 24.

The construction of the housing 62 is peripheral to the present invention. A suitable construction for the housing 62 is shown in co-pending application Ser. No. 676,825, assigned to the assignee of this invention. Generally, the housing 62 has a trough-shaped base 64 to which a cover 66 is pivotably connected through a pin 68. By pivoting the cover 66 out of the closed position, shown in FIG. 4, the entryways (not shown) to a plurality of slots in the base 64 are exposed to allow the cable 24 to be pressed thereinto. The width of the slot 70 is slightly larger than the diameter of the cable 12 but less than the diameter of the shoulder 60 on the end fitting 58. Consequently, the cable end 34 must be pressed into the slot 70 in a direction transverse to the length of the cable 12 so that the end fitting 58 moves into the spaced bounded by the base 64. By then closing the cover 56, the cable 12 is precluded by the wall 72 from being drawn lengthwise to be separated from the housing 62. More specifically, the wall 72 defines the slot 70 and abuts the end fitting 58 as withdrawal of the cable 12 is attempted. A suitable locking mechanism (not shown) can be used to maintain the housing cover 66 closed and to allow only authorized entry, as with a key.

The principal focus of the present invention is to prevent tangling of the coil 36 in use. As the user draws the garment 16 off of the hanger 30 and places the garment 16 on, the coil 36 is stretched to increase the effective length of the cable 12. Typically, the coil 36 is configured to allow approximately two feet of extension so that the overall cable length is approximately eight feet, which thereby comfortably accommodates a user's wearing of the lassoed garment 16.

In a conventional construction, the repeated extension and retraction of the coil 36 results in the tangling of the cable. This phenomenon is commonly encountered using conventional cords on telephones between the handset and receiver thereon. Once this occurs, this tangling prevents full extension of the cable 12 which may thereby preclude the user's wearing of the lassoed garment 16. At the same time, the tangled coil 36 tends to bunch up in the garment sleeve 54 to thereby inhibit placement of the user's arm through the sleeve 54.

According to the invention, a means is provided for controlling the tendency of the coil to tangle as the coil is repeatedly extended and retracted. In a preferred form, first and second turns 74, 76, respectively, on the coil 36 are connected together by a crimp fitting 78 on one end 80 of the coil 36. The crimp fitting 78 has a plastic coating or sleeve 79 thereon for aesthetic purposes and to prevent exposure thereby to the user and displayed garments. Similarly, third and fourth turns 82, 84 on the other coil end 86 are connected by a crimp fitting 88. The first turn 74 is contiguous with the cable end 32 whereas the fourth turn 84 is contiguous with the cable end 34.

The inventors herein believe that the connection of the coil turns results in a redirection of the stretching forces on the cable 12 which causes the coil turns to evenly wind and unwind to thereby control the tendency of the coil 36 to tangle as the coil 36 is extended and retracted in use. Thus, the user realizes the benefit of the extensible coil 36 without the drawback of the potential tangling of the cable 12.

It has been found that the most effective control of tangling is realized by connecting the end turns. However, tangle control is realized by connecting other turns in the coil 36. Similarly, it is not necessary, although it is preferred, to connect turns at both ends 80, 86 of the coil.

The foregoing disclosure of specific embodiments is intended to be illustrative of the broad concepts comprehended by the invention.

We claim:

1. A security device comprising:

an elongate, flexible cable having a preformed coil, said cable being sufficiently flexible to allow it to be readily looped around an article to be secured, said coil being defined by at least three turns of said cable which readily extend and retract to allow the effective length of said cable to be altered between a) a first effective length with the coil in a relaxed state and b) a second effective length that is longer than the first effective length with the coil in a stretched state, said at least three turns being wrapped about substantially the same axis with the coil in its relaxed state, the turns of the preformed coil tending to draw the coil from its stretched state back to its relaxed state, said turns of the coil being preformed so that the turns of the coil would not unwrap if the cable were allowed to twist about its length;

first means for connecting a first and second of said at least three turns to each other to control the tendency of said coil to tangle as said coil is extended and retracted; wherein the first and second turns are prevented from spreading away from each other lengthwise at said first means and second means for connecting the cable to an article to be secured to prevent separation of said cable from an article to be secured.

2. The security device according to claim 1 wherein said cable has a metal core.

3. The security device according to claim 2 wherein said metal core is defined by woven metal strands.

4. The security device according to claim 3 wherein said cable has an outer sheath made from a material that is softer than said metal core.

5. The security device according to claim 1 wherein the cable has spaced ends and the second connecting means includes a loop formed by the cable for allowing passage therethrough of one of the cable ends to define a constrictable lasso.

6. The security device according to claim 5 wherein there are means on the one cable end for connection to an anchoring mechanism to thereby fix the cable.

7. The security device according to claim 1 wherein the first connecting means comprises a crimp fitting that surrounds the first and second turns.

8. The security device according to claim 1 wherein the coil has at least five turns and there is a third connecting means for connecting a third and fourth of said turns to each other.

9. The security device according to claim 1 wherein the cable has a straight, uncoiled section connected directly to one of said first and second turns.

10. The security device according to claim 9 wherein the cable has spaced ends with one said spaced end being defined by said straight section and the second connecting means includes a loop formed by the cable for allowing passage therethrough of the one cable end.

11. A security device comprising:

an elongate flexible cable having spaced ends;

a preformed coil between the spaced cable ends, said preformed coil being defined by at least three turns of a flexible element which readily extend and retract to allow the effective length of the cable to be altered between a) a first effective length with the coil in a relaxed state and b) a second effective length that is longer than the first effective length with the coil in a stretched state, the turns of the preformed coil tending to draw the coil from its stretched state back to its relaxed state, said at least three turns being wrapped about substantially the same axis with the coil in its relaxed state, said turns of the cable being preformed so that the turns of the coil would not unwrap if the cable were allowed to twist about its length;

first means for connecting a first and second of said at least three turns to each other so as to prevent said first and second turns from spreading away from each other lengthwise of the coil at said first connecting means; and second means for connecting the cable to an article to be secured by the cable, said cable having sufficient flexibility to allow it to be passed through the sleeve of a garment and doubled back on itself to secure such a garment.

12. The security device according to claim 11 wherein said cable has at least one straight section connected to said preformed coil, said straight section and preformed coil being continuously defined as one piece.

13. The security device according to claim 12 wherein the connecting means includes a loop defined on the straight section to allow passage therethrough of a part of the cable to define a constrictable lasso.

14. The security device according to claim 12 wherein the connecting means comprises a crimp fitting that surrounds the first and second turns.

15. The security device according to claim 12 wherein the coil has at least five turns and there is a third connecting means for connecting a third and fourth of said coils to each other.

16. The security device according to claim 11 wherein said cable has first and second straight sections and one of the first and second straight sections is attached directly to one of the first and second coils.

17. The security device according to claim 16 wherein the coil has at least five turns, there is a third connecting means for connecting a third and fourth of said coils to each other and the other of the first and second straight sections is attached directly to one of the third and fourth turns.

18. A security device comprising:

an elongate flexible cable having first and second ends;

a preformed coil defined by a plurality of turns of a flexible element between the cable ends which turns extend and retract to allow the effective length of the cable between the first and second ends to be altered between a) a first effective length with the coil in a relaxed state and b) a second effective length that is longer than the first effective length with the coil in a stretched state, said plurality of turns being wrapped about substantially the same axis with the coil in its relaxed state, the turns of the preformed coil tending to draw the coil from its stretched state back to its relaxed state, said turns of the cable being preformed so that the turns of the coil would not unwrap if the cable were allowed to twist about its length; and means connecting between at least two of said plurality of turns for controlling the tendency of the coil to tangle as the coil is extended and retracted. said means preventing two of said turns from spreading away from each other lengthwise 19. The security device according to claim 18 including means for connecting the cable to an article to be secured to prevent separation of said cable from an article to be secured.

20. The security device according to claim 19 wherein said connecting means includes a loop on one of the first and second cable ends for allowing passage therethrough of the other of the first and second cable ends to thereby define a constrictable lasso.

* * * * *